US006461125B1

(12) United States Patent
Terasawa et al.

(10) Patent No.: US 6,461,125 B1
(45) Date of Patent: Oct. 8, 2002

(54) AIR PUMP, AIR CHAMBER DEVICE USING AIR PUMP, AND WRISTWATCH HAVING AIR CHAMBER DEVICE

(75) Inventors: Dai Terasawa; Hiroki Hanawa, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/529,764

(22) PCT Filed: Oct. 13, 1998

(86) PCT No.: PCT/JP98/04587

§ 371 (c)(1),
(2), (4) Date: Jun. 26, 2000

(87) PCT Pub. No.: WO99/20902

PCT Pub. Date: Apr. 29, 1999

(30) Foreign Application Priority Data

Oct. 20, 1997 (JP) ..... 9-287279
Oct. 20, 1997 (JP) ..... 9-287280
Aug. 20, 1998 (JP) ..... 10-234600

(51) Int. Cl.[7] ..... F04B 43/00

(52) U.S. Cl. ..... 417/479; 368/282; 224/164; 224/181

(58) Field of Search ..... 417/479; 368/282; 224/164–181

(56) References Cited

U.S. PATENT DOCUMENTS 2,701,672 A * 2/1955 Glasco ..... 226/20.6
5,099,885 A * 3/1992 Nilsson ..... 137/852
5,152,753 A * 10/1992 Laguette et al. ..... 604/153
5,663,932 A * 9/1997 Weng ..... 368/10
5,769,290 A * 6/1998 Pestana ..... 224/178

OTHER PUBLICATIONS

Brady, George S., Clauser, Henry R. and Vaccari, John A. Materials Handbook, New York, McGraw–Hill, Fourteenth edition, 1997.*
Academic Press Dictionary of Science and Technology, Harcourt, Inc.*

* cited by examiner

*Primary Examiner*—Charles G. Freay
*Assistant Examiner*—W Rodriguez
(74) *Attorney, Agent, or Firm*—Adams & Wilks

(57) ABSTRACT

An air chamber device has an air pump having a first air discharge valve, an air chamber connected to the air pump for receiving air discharged by the first air discharge valve, and a second air discharge valve for discharging air from the air chamber. The air pump has an elastic body having an upper elastic part and a lower elastic part connected together to define an interior space. At least one through-hole is formed in the upper elastic part for introducing ambient air into the interior space. The first air discharge valve is connected to the elastic body for discharging air therethrough from the interior space when pressure is applied to the upper elastic part of the elastic body to elastically deform same while closing the through-hole to thereby reduce a volume of air in the interior space, and for preventing back-flow of air therethrough into the interior space when the pressure applied to the upper elastic part is released and the through-hole is opened so that ambient air is introduced through the through-hole and into the interior space.

24 Claims, 6 Drawing Sheets

Fig. 1 ( A )
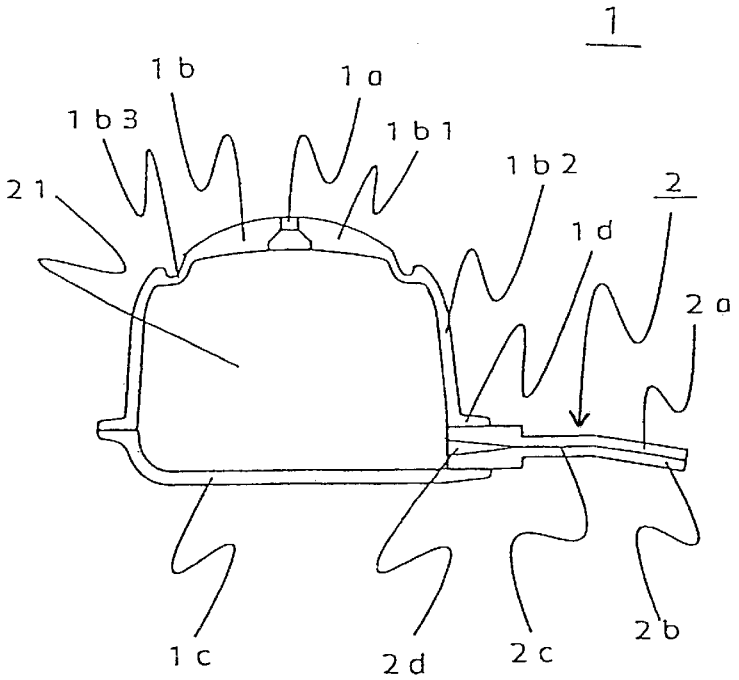
Fig. 1 ( B )
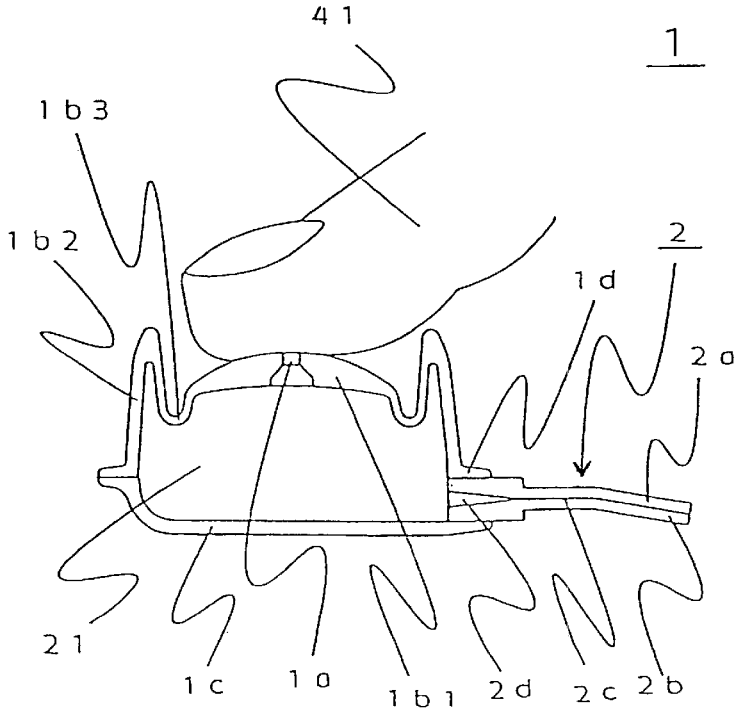

AIR PUMP, AIR CHAMBER DEVICE USING AIR PUMP, AND WRISTWATCH HAVING AIR CHAMBER DEVICE

BACKGROUND OF THE INVENTION

1. Technical Field

The present invention relates to an air pump having an air introducing through hole, an air chamber device provided with a function of introducing and discharging air and a wrist watch provided with the air chamber device.

2. Background Art

According to a conventional air pump, an inner volume thereof can be reduced by depressive pressure of a user's finger or the like, a flat bottom face portion thereof is provided with an outside air introducing portion and an air discharging portion and the other inner face of the air pump is hermetically closed. The air introducing portion is provided with a valve which is opened by reducing inner pressure of the air pump in comparison with outer pressure thereof by increasing the inner volume of the pump when the depressive pressure of the air pump is excluded (for example, refer to International Patent Publication No. 503052/1995).

Further, according to a conventional wrist watch, a pair of straps are respectively arranged on the 12 o'clock side and the 6 o'clock side of a case in order to wear the watch on the arm and the wrist watch is fixed to the arm in a state in which a rigid back case and the straps are brought into direct contact with the arm. Further, there are known straps having a function of adjusting the length in order to correspond to a length around the arm of the user.

According to the conventional air pump, the outside air introducing portion and the air discharging portion are constituted to be opened and closed by a pressure difference which limits the construction and downsizing of the air pump.

Further, the conventional wrist watch is worn by bringing the rigid back case into direct contact with the arm and accordingly, a change in the shape of the arm in wearing thereof, is absorbed by a change in the shape of the straps, elastic force thereof and the like with the back case face constituting a reference face and accordingly, there poses a problem in which it is difficult to provide always agreeable wearing performance.

Further, portions of fitting the case and the straps are arranged on an upper face side of the back case face which is brought into contact with the arm and accordingly, there poses a problem in which there are present spaces constituting clearances between vicinities of the fitting portions and the arm and a change in the length around of the arm produced in moving the arm causes a shift of the wrist watch.

SUMMARY OF THE INVENTION

According to an air pump and an air chamber device of the invention, a valve of an outside air introducing portion is dispensed with by providing a through hole at a portion where the user's finger is brought into contact with the air pump when the air pump is depressed by the finger.

According to the invention, the through hole is closed by the finger when the pump, is depressed by the finger since the through hole is provided at the position where the finger is brought into contact with the pump when the pump is depressed by the finger. Further, when the depressive pressure is released, the finger is detached from the through hole and the through hole is opened. Accordingly, the through-hole of the pump according to the, invention carries out operation of the valve via the finger.

According to a wrist watch provided with an air chamber device of the invention, an air chamber having elasticity by air is arranged at a rigid portion thereof which is brought into direct contact with the arm and portions constituting clearances at vicinities of fitting portions.

Operating portions of an air pump and an air discharge valve are arranged on the surface side of the case. By attaching the air chamber device to the wrist watch in this way, the above-described problem is resolved.

According to the invention, air chamber members having elasticity by air are arranged at the rigid portion which is brought into direct contact with the arm and the portions constituting the clearances at the vicinities of the fitting portions and accordingly, the wrist watch can firmly be fixed without giving an unpleasant feeling to the arm.

Further, since the operating portions of the air pump and the air discharging valve are arranged on the surface side of the case, air can be introduced and discharged in a state in which the wrist watch is worn by the arm and an adjustment of an amount of air at inside of the air chamber can easily be realized while wearing the wrist watch on the arm.

BRIEF DESCRIPTION OF THE DRAWINGS

FIG. 1(A) shows a sectional view of an air pump according to the invention.

FIG. 1(B) is a sectional view showing a deformed state of the air pump when an upper portion of the air pump according to the invention is depressed by the finger.

DETAILED DESCRIPTION OF THE PREFERRED EMBODIMENTS

An explanation will be given of embodiments of the invention with reference to the drawings.

FIG. 1(A) is a sectional view of an air pump 1 according to the invention and FIG. 1(B) is a sectional view showing an example of a deformed state of the air pump 1 when an upper portion thereof constituting an operating portion of the air pump 1 is depressed by the finger.

The pump 1 comprises an elastic body comprised of an upper elastic part in the form of a bulge 1*b* and a lower elastic part in the form of a flat bottom face 1*c* connected to the bulge portion 1*b* to define an interior space. The bulge portion 1*b* of the air pump 1 is formed by an elastic material of urethane, silicone rubber or the like and a through hole 1*a* for introducing air from outside into the interior space 21 is provided at an upper portion of the bulge portion 1*b* of the air pump 1. Further, a plurality of the through holes 1*a* can also be constituted as necessary in order to ensure a flow rate of air or the like.

When an external force is not applied to the upper outer surface of the bulge portion 1*b*, the shape of the air pump 1 is formed in a dome-like shape as shown by FIG. 1(A).

The bulge portion 1*b* is formed with a thick-walled depressing portion 1*b*1 at an upper portion thereof and a thin-walled cylindrical portion 1*b*2 at an outer wall portion thereof, and an interconnecting portion between the depressing portion 1*b*1 and the cylindrical portion 1*b*2 is formed by a thin-walled groove portion 1*b*3. Accordingly, when the bulge portion 1*b* of the air pump 1 is deformed by depressive pressure of the user's finger from the outer surface of the bulge portion 1*b*; air inside the interior space 21 is compressed and air flows out from an air hold valve 2 and a deformed state thereof is as shown by FIG. 1(B).

The through hole 1*a* is closed by the finger 41 and accordingly, compressed air is delivered to outside via the air hold valve 2. Further, when external force, that is, depressive pressure of the finger is removed, the finger 41 which has been closing the through hole 1*a* is removed, outside air is introduced into the interior space 21 from the through hole 1*a* and the air pump 1 is recovered to an original shape as shown by FIG. 1(A) by recovery force of the bulge portion 1*b*.

Figure 4:
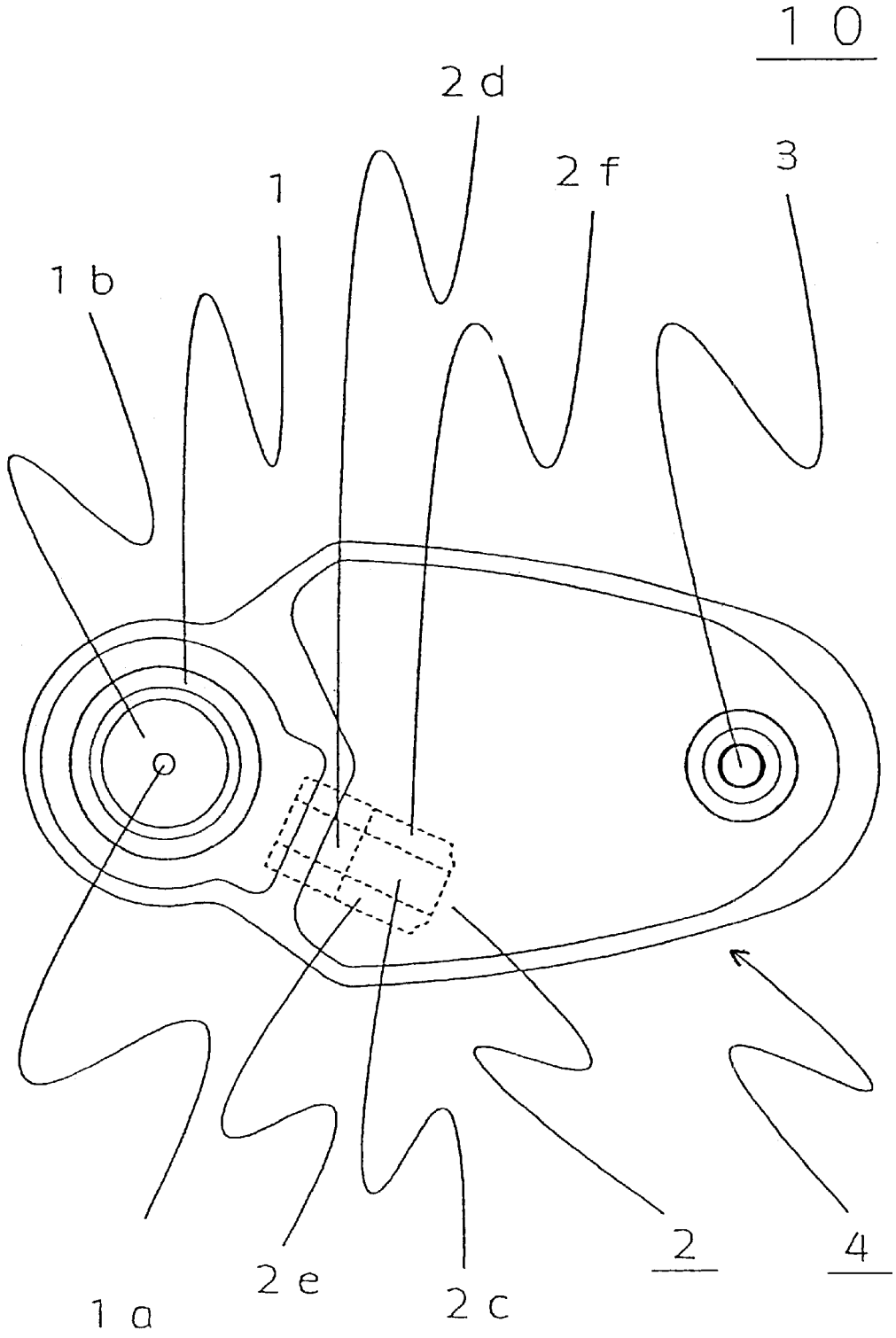
FIG. 4 is an integrated plane view of the air chamber device according to the invention.

Further, as shown by FIG. 1(A) and FIG. 4, according to the air hold valve 2 per se formed by an elastic material comprised of urethane, silicone rubber or the like, a valve member 2*a* on an upper side and a valve member 2*b* on a lower side are fixedly attached to each other by a method of adhering, welding or the like at bonding portions 2*e* and 2*f* on both sides thereof while leaving a hollow portion 2*d* and a contact portion 2*c* constituting an air passing portion. The valve member 2*a* on the upper side and the valve member 2*b* on the lower side can also be formed by an elastic material in a film-like shape.

The air hold valve 2 is constructed by a constitution in which a lower portion 1*d* thereof below the, valve portion 1*b* and the flat bottom face 1*c* formed by an elastic material of silicone rubber, urethane or the like are fixed to each other by a method of adhering, welding or the like and air is passed only in one direction from the bulge portion 1*b* to outside.

Figure 3:
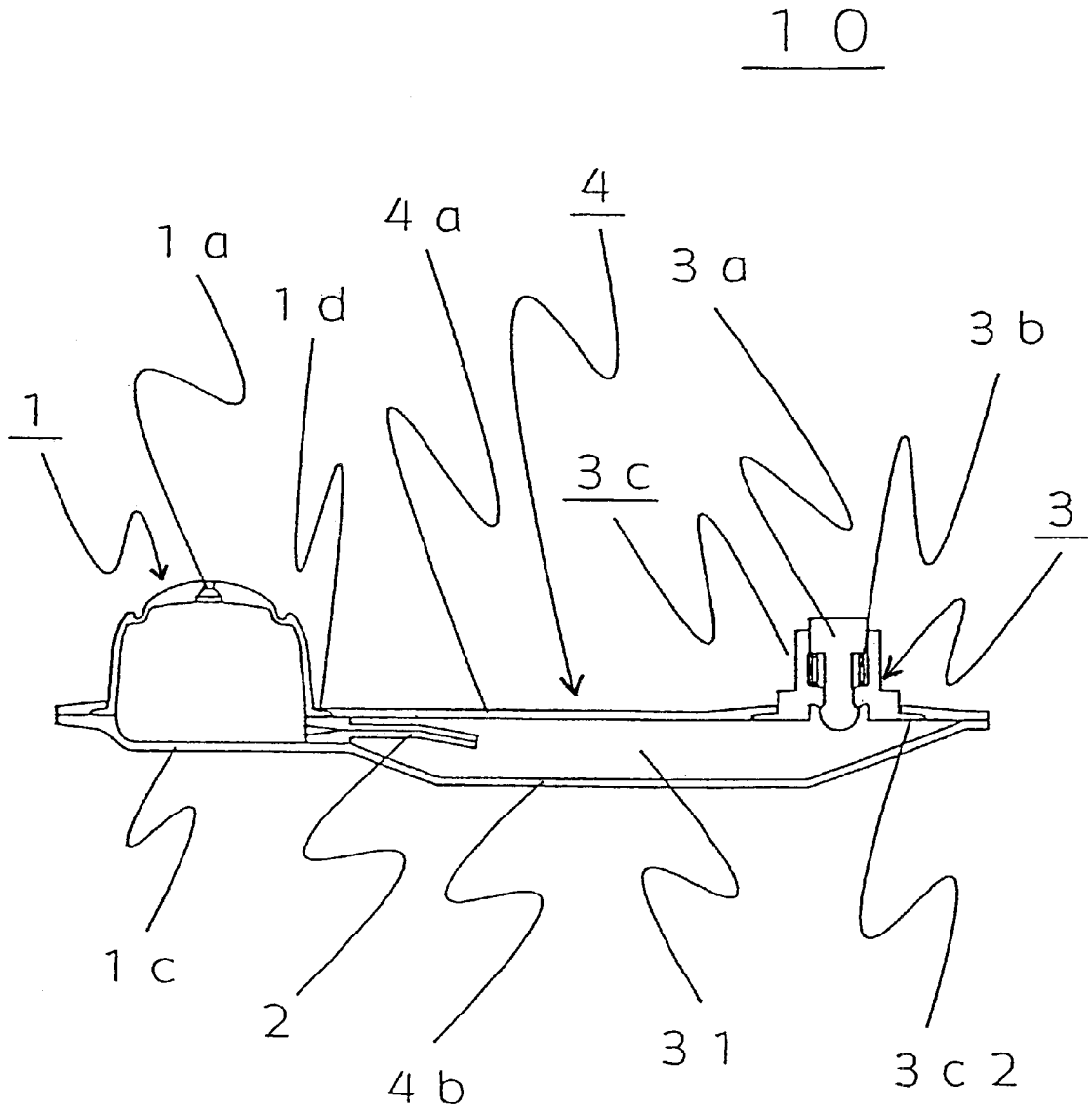
FIG. 3 is an integrated sectional view of an air chamber apparatus according to the invention.

An air chamber device 10 is constituted by an air chamber 4, the air pump 1 and an air discharge valve 3 as shown by FIG. 3 which is an integrated sectional view thereof and FIG. 4 which is an integrated plane view thereof.

The inner surface of the air chamber 4 are formed by an elastic material in a film-like shape comprised of urethane, silicone rubber or the like. Outer surfaces thereof are formed by stretching cloth, stretching-skin or the like.

That is, according to a film-like elastic material 4*a* on an upper side and a film-like elastic material 4*b* on a lower side, there is provided a hollow inner portion 31 and outer peripheral portions thereof are fixed together by a method of adhering, welding or the like such that respective faces of the film-like elastic materials of urethane, silicone rubber or the like are aligned to overlap.

The air chamber 4 is attached with the air pump 1 for introducing air at a predetermined position. There is provided the air hold valve 2 between the air pump 1 and the air chamber 4 for passing air flowing from the pump 1 to the air chamber 4 and preventing air from flowing back conversely from the air chamber 4 to the pump 1. Further, at a predetermined position of the air chamber 4, there is attached the air discharge valve 3 constituted by a button 3*a*, a button biasing member or returning spring 3*b* and a tubular member or pipe 3*c* for discharging air.

An upper face portion of the expanded portion 1*d* below the bulge portion 1*b* of the air pump 1 and an upper face portion of an expanded portion 3*c*2 below the pipe 3*c*, are respectively fixed by the film-like elastic material 4*a* on the upper side by a method of adhering, welding or the like.

That is, the pipe 3*c* is formed by an elastic member of silicone rubber, urethane or the like and is fixed at a predetermined position of the air chamber 4 remote from the air pump 1 by a method of adhering, welding or the like. Further, as shown by FIG. 3, the film-like material 4*b* on the lower side of the air chamber device 10 serves also as the flat bottom face portion of the air pump 1.

The air hold valve 2 is fixed to the inside of the air chamber 4 by a method of adhering, welding or the like and divides a space at inside of the air chamber device 10 to a side of the air pump 1 and a side of the air discharge valve 3 via the air hold valve 2.

By arranging the air hold valve 2 in this way, air delivered from the pump 1 is held at inside of the air chamber 4 on the side of the air discharge valve and air is prevented from being flowed back from the side of the air discharge valve to the side of the air pump.

Figure 2A:
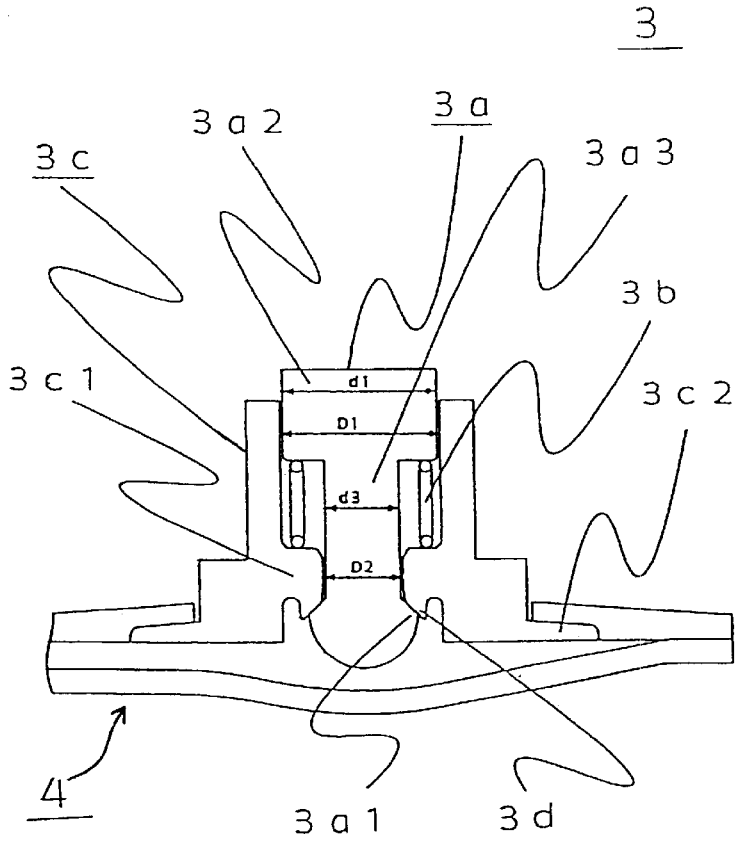
FIG. 2(A) shows an integrated sectional view of an air discharge valve according to the invention.
Figure 2B:
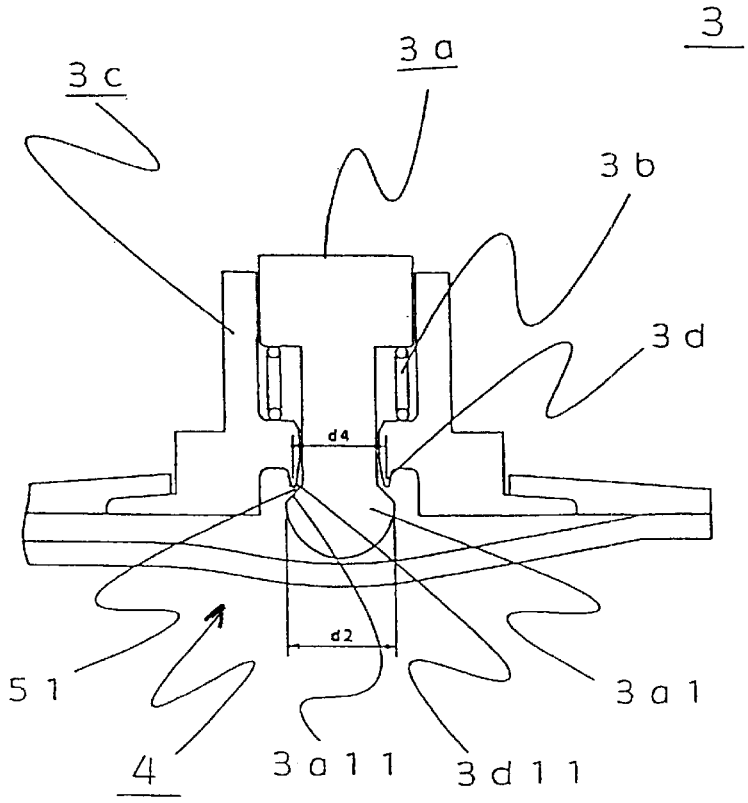
FIG. 2(B) shows an integrated sectional view in which a button of the air discharge valve according to the invention is operated.

FIG. 2(A) shows an enlarged section of the air discharge valve 3 and FIG. 2(B) is a sectional view showing a deformed state of the air discharge valve 3 when the button 3*a* is depressed from above by the finger or the like.

A projected portion 3*d* is provided at an inner flange 3*c*1 of an inner diameter portion of the pipe 3*c*. The inner diameter portion of the pipe 3*c* is inserted with the button 3*a* provided with a flange 3*a*2 of the button 3*a* at an upper end thereof and provided with an expanded portion 3*a*1 at a lower-end of the button 3*a*.

The button returning spring 3*b* is inserted between the flange 3*a*2 of the button 3*a* and the inner flange 3*c*1 of the pipe 3*c*. An outer diameter d1 of the flange 3*a*2 of the button 3*a* is made slightly smaller than an inner diameter D1 of the pipe 3*c*.

An outer diameter d3 of an intermediary portion of the button 3*a* is made slightly smaller than an inner diameter D2 of the inner flange 3*c*1 of the pipe 3*c*.

An outer diameter d2 of the expanded portion 3*a*1 of the button 3*a* is made slightly larger than an outer diameter d4 of a front end of the projected portion 3*d* of the pipe 3*c*.

The button 3*a* is mounted by pushing the expanded portion 3*a*1 from above by depressing pressure of the finger or the like, against spring force of the button returning spring 3*b* to thereby penetrate a hole D2 provided at the inner flange 3*c*1 of the pipe 3*c* and to thereby elastically deform the projected portion 3*d*.

As shown by FIG. 2(A), normally, the button 3*a* is pushed up by pressure of air in the air chamber 4 and the spring force of the button returning spring 3*b*. Further, an inner inclined face 3*d*11 of the projected portion 3*d* of the pipe 3*c* and an outer inclined face 3*a*11 of the expanded portion 3*a*1 of the button 3*a* are brought into close contact with each other to thereby provide airtightness and air stored in the air chamber 4 is not discharged. At this occasion, as shown by FIG. 2(A), the projected portion 3*d* constitutes an elastically compressed portion to thereby form a so-to-speak interference portion.

When an upper portion of the flange 3*a*2 of the button 3*a* is pushed by the finger, as shown by FIG. 2(B), the button

3*a* is lowered against the spring force of the button returning spring 3*b,* a clearance 51 is produced between the inner inclined face 3*d*11 of the projected portion 3*d* of the pipe 3*c* and the outer inclined face 3*a*11 of the expanded portion 3*a*1 of the button 3*a* and air stored in the air chamber 4 is discharged via the air discharge valve 3. That is, by operating the button 3*a* receiving repulsive force of the button returning spring 3*b,* at the interference portion constituted by the expanded portion 3*a*1 and the projected portion 3*d,* there can be brought about two states of an air tight state of air and a released state of air. Thereby, air at inside of the air chamber 4 can be held, discharged and adjusted.

Figure 5:
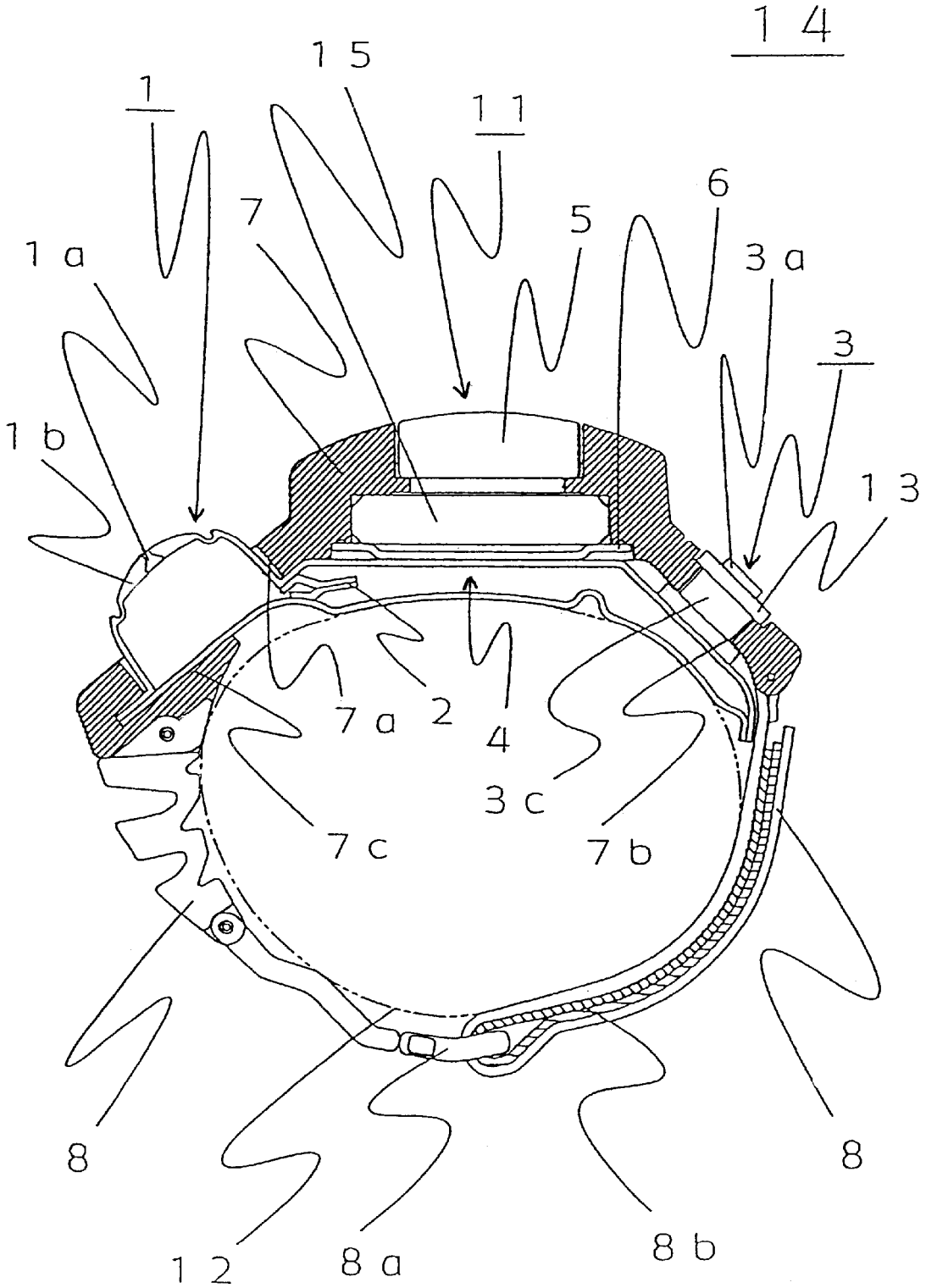
FIG. 5 is an integrated sectional view of a wrist watch provided with an air chamber device according to the invention.

FIG. 5 is an integrated sectional view of a wrist watch 14 showing an embodiment according to the invention. A case body 7 containing a movement 15 constituting a timepiece member is attached with glass 5. A back cover 6 is attached to a back side of the case body 7.

A strap 8 for wearing the timepiece on the arm is integrated to both end portions of the case body 7.

An air pump integrating hole 7*a* constituting a hole for inserting the air pump 1 is provided at a vicinity of one of strap attaching portions of the case body 7 and a hole 7*b* for integrating the air discharges valves constituting a hole for inserting the pipe 3*c* of the air discharge valve 3 is provided at a vicinity of other of the band attaching portions.

The air pump 1 is integrated to the pump integrating hole 7*a* and the air discharge valve 3 is integrated to the air discharge valve integrating hole 7*b,* respectively, and the air chamber 4 is arranged on a lower face side of the back cover 6. Further, according to the air pump 1, the bottom face portion 1*c* is supported by an air pump receiving base 7*c* formed at a lower portion of an end of of the case body 7 and the air discharge valve 3 is fixedly supported by the case body 7 by an air discharge valve supporting member of a fixing ring 13 or the like constituting an air discharge valve receiving member formed at an upper portion of other end of the case body 7.

The wrist watch can firmly be fixed onto the arm without giving an unpleasant feeling by such a constitution.

Further, the operating portions of the a air pump 1 and the air discharge valve 3 are arranged on the surface side of the case 11 and accordingly air can be introduced and discharged in a state in which the wrist watch 13 is worn by the arm and an adjustment of an amount of air in the air chamber can easily be realized while the wrist watch is being attached to the arm.

Figure 6:
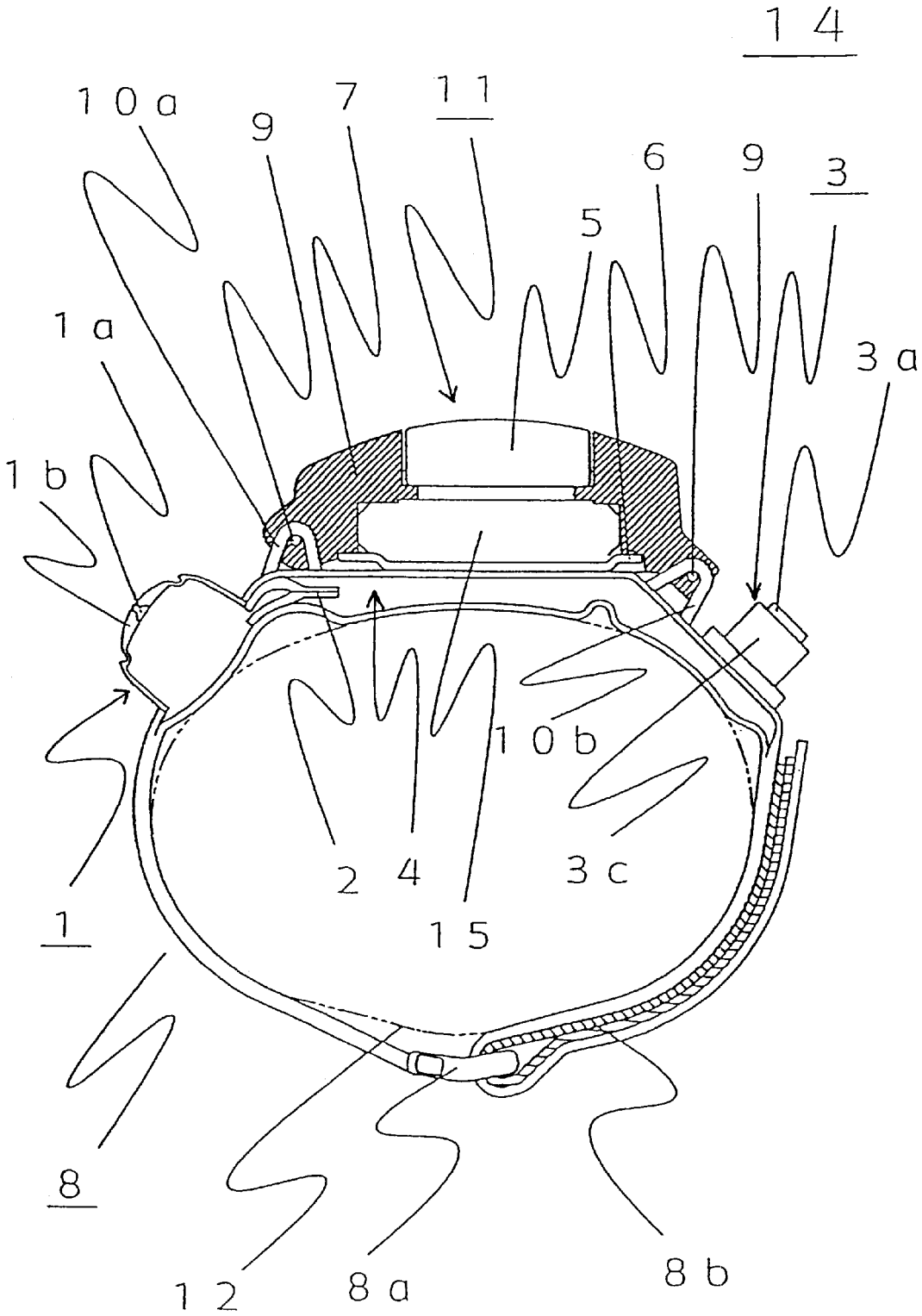
FIG. 6 is an integrated sectional view of a wrist watch provided with an air chamber device showing another embodiment according to the invention.

FIG. 6 is an integrated sectional view of a wrist watch showing another embodiment according to the invention. The case body 7 is integrated with the glass 5, the case back 6, spring bars 9 and so on.

The air chamber 4 is arranged on the lower face side of the back cover 6 and at the same time, the air pump 1 and the air discharge valve 3 are integrated respectively to the case body 7 by engaging locking portions 10*a* and 10*b* of the air chamber device 10 to the spring bars 9. Further, a buckle 8*a* and a magic tape 8*b* are respectively attached to portions of extending both ends of the air chamber device 10 to thereby provide the function of the strap 8. An effect similar to that of the constitution shown by FIG. 5 is achieved by such a constitution.

Industrial Applicability

According to an air pump and an air chamber device of the invention, by providing a through hole at an upper portion of a bulge portion of the air pump, a function of a valve can be provided to the through hole and an air pump and an air chamber device having simplified structures with downsized formation can be realized.

According to a wrist watch provided with an air chamber device of the invention, the air chamber device is arranged between the arm and a case and accordingly, the wrist watch can firmly be fixed without giving an unpleasant feeling to the arm and an excellent wear feeling can be given.

Although a length around of the arm is changed when the arm is moved and in accordance with time zones, an amount of the change is absorbed by elasticity of an air chamber. Accordingly, a shift of a carried time piece from the arm can be prevented.

Further, when some impact is applied from outside to the timepiece, impact force is absorbed by the elasticity of the air chamber and not only the wrist watch but also the arm can be protected.

Further, operating portions of the air pump and an air discharge valve are arranged on a surface side of the case and accordingly, in a state in which the wrist watch is worn by the arm, air can be introduced and discharged and the wear state can easily be adjusted at all times by a carrier per se.

What is claimed is:

1. An air chamber device comprising: an air pump comprised of an elastic body having an upper elastic part and a lower elastic part connected together to define an interior space, at least one through-hole formed in the upper elastic part for introducing ambient air into the interior space, and a first air discharge valve connected to the elastic body for discharging air therethrough from the interior space when pressure is applied to the upper elastic part of the elastic body to elastically deform same while closing the through-hole to thereby reduce a volume of air in the interior space, and for preventing back-flow of air therethrough into the interior space when the pressure applied to the upper elastic part is released and the through-hole is opened so that ambient air is introduced through the through-hole and into the interior space; an air chamber connected to the air pump for receiving air discharged by the first air discharge valve; and a second air discharge valve for discharging air from the air chamber.

2. A air chamber device according to claim 1; wherein the air chamber is airtight and has an inner surface comprised of elastic material.

3. An air chamber device according to claim 2; wherein the elastic material comprises silicone rubber.

4. An air chamber device according to claim 2; wherein the elastic material comprises urethane.

5. An air chamber device according to claim 1; wherein the second air discharge valve comprises a tubular member having an air passage through which air from the air chamber is discharged, a button positionable in a first position to close the air passage of the tubular member to prevent discharge of air from the air chamber and a second position in which the air passage is open to allow air from the air chamber to be discharged therethrough, and a biasing member for biasing the button to the first position.

6. An air chamber device according to claim 1; further comprising a strap for attaching the air chamber device to a wrist of a user.

7. An air chamber device according to claim 6; wherein the strap comprises a buckle extending from a first end of the air chamber and a strip of material extending from a second end of the air chamber opposite the first end thereof for connection to the buckle.

8. An air chamber device according to claim 1; wherein the upper elastic part of the air pump comprises a first portion having the through-hole, a second portion having a thickness smaller than that of the first portion, and an interconnecting portion disposed between the first and second portions to allow pressure to be applied to the first portion relative to the second portion while closing the through-hole to reduce the volume of air in the interior space.

9. An air chamber device according to claim 1; wherein the first air discharge valve comprises a first valve member and a second valve member connected together to form a hollow portion disposed in fluid communication with the interior space and to form an air passage communicating with the hollow portion for passing air therethrough from the interior space when pressure is applied to the upper elastic part of the elastic body while closing the through-hole.

10. An air chamber device according to claim 1; wherein the at least one through-hole of the air pump comprises a plurality of through-holes.

11. A wristwatch comprising:

a case body;

a timepiece movement disposed in the case body;

a glass member connected to an upper end of the case body;

a cover member connected to a lower end of the case body;

a strap member connected to the case body for strapping the wrist watch to a wrist of a user; and an air chamber device connected to the case body and positionable between the cover member and the wrist of the user when the wristwatch is strapped to the user's wrist, the air chamber device having an air pump having a first air discharge valve, an air chamber connected to the air pump for receiving air discharged by the first air discharge valve, and a second air discharge valve for discharging air from the air chamber, the air pump being comprised of an elastic body having an upper elastic part and a lower elastic part connected together to define an interior space, and at least one through-hole formed in the upper elastic part for introducing ambient air into the interior space, the first air discharge valve being connected to the elastic body for discharging air therethrough from the interior space when pressure is applied to the upper elastic part of the elastic body to elastically deform same while closing the through-hole to thereby reduce a volume of air in the interior space, and for preventing back-flow of air therethrough into the interior space when the pressure applied to the upper elastic part is released and the through-hole is opened so that ambient air is introduced through the through-hole and into the interior space.

12. A wristwatch according to claim 11; wherein the air chamber of the air chamber device is airtight and has an inner surface comprised of elastic material.

13. A wristwatch according to claim 12; wherein the elastic material comprises silicone rubber.

14. A wristwatch according to claim 12; wherein the elastic material comprises urethane.

15. A wristwatch according to claim 12; wherein the second air discharge valve of the air chamber device comprises a tubular member having an air passage through which air from the air chamber is discharged, a button positionable in a first position to close the air passage of the tubular member to prevent discharge of air from the air chamber and a second position in which the air passage is open to allow air from the air chamber to be discharged therethrough, and a biasing member for biasing the button to the first position.

16. A wristwatch according to claim 12; wherein at least a portion of the air chamber of the air chamber device is disposed on a lower surface side of the cover member.

17. A wristwatch according to claim 11; wherein the case body has first and second oppositely extending portions, the first portion having a first hole for receiving the elastic body of the air pump so that the upper elastic part of the elastic body protrudes from an upper surface of the first portion, and the second portion having a second hole for receiving the second air discharge valve of the air chamber device so that the button protrudes from an upper surface of the second portion.

18. A wristwatch according to claim 17; wherein the air chamber of the air chamber device is airtight and has an inner surface comprised of elastic material.

19. A wristwatch according to claim 17; wherein the second air discharge valve of the air chamber device comprises a tubular member having an air passage through which air from the air chamber is discharged, a button positionable in a first position to close the air passage of the tubular member to prevent discharge of air from the air chamber and a second position in which the air passage is open to allow air from the air chamber to be discharged therethrough, and a biasing member for biasing the button to the first position.

20. A wristwatch according to claim 17; wherein at least a portion of the air chamber of the air chamber device is disposed on a lower surface side of the cover member.

21. A wristwatch according to claim 17; wherein the first portion of the case body has a support portion for supporting the lower elastic part of the air pump; and further comprising a support member for supporting the second discharge valve in the second hole of the case body.

22. A wristwatch comprising:

a case body;

a timepiece movement disposed in the case body;

an air chamber device having an air pump having a first air discharge valve, an air chamber connected to the air pump for receiving air discharged by the first air discharge valve, and a second air discharge valve for discharging air from the air chamber, the air pump being comprised of an elastic body having an upper elastic part and a lower elastic part connected together to define an interior space, and at least one through-hole formed in the upper elastic part for introducing ambient air into the interior space, the first air discharge valve being connected to the elastic body for discharging air therethrough from the interior space when pressure is applied to the upper elastic part of the elastic body to elastically deform same while closing the through-hole to thereby reduce a volume of air in the interior space, and for preventing back-flow of air therethrough into the interior space when the pressure applied to the upper elastic part is released and the through-hole is opened so that ambient air is introduced through the through-hole and into the interior space; and connecting means for connecting the air chamber device to the case body.

23. A wristwatch according to claim 22; wherein the connecting means comprises a plurality of locking elements for connecting the air chamber device to the case body.

24. A wristwatch according to claim 23; wherein the connecting means further comprises a plurality of spring elements for respective connection to the locking elements.

* * * * *